US012264475B2

(12) United States Patent
Shaw et al.

(10) Patent No.: US 12,264,475 B2
(45) **Date of Patent: *Apr. 1, 2025**

(54) TOPPING SLAB INSTALLATION METHODOLOGY

(71) Applicant: Shaw Craftsmen Concrete, LLC, Costa Mesa, CA (US)

(72) Inventors: Ronald D. Shaw, Costa Mesa, CA (US); Jeff Counterman, Costa Mesa, CA (US)

(73) Assignee: SHAW CRAFTSMEN CONCRETE, LLC, Costa Mesa, CA (US)

( * ) Notice: Subject to any disclaimer, the term of this patent is extended or adjusted under 35 U.S.C. 154(b) by 157 days.

This patent is subject to a terminal disclaimer.

(21) Appl. No.: 18/156,242

(22) Filed: Jan. 18, 2023

(65) Prior Publication Data

US 2023/0332404 A1 Oct. 19, 2023

Related U.S. Application Data

(63) Continuation of application No. 16/784,585, filed on Feb. 7, 2020, now Pat. No. 11,578,491.

(51) Int. Cl.
*E04C 5/06* (2006.01)
*E04B 5/32* (2006.01)

(52) U.S. Cl.
CPC ..... *E04C 5/0645* (2013.01); *E04B 5/32* (2013.01); *E04B 2005/324* (2013.01); *E04B 2103/02* (2013.01)

(58) Field of Classification Search
CPC ..... E04C 5/0645; E04C 5/165; E04B 5/32; E04B 2103/02; E04B 2005/324;
(Continued)

(56) References Cited

U.S. PATENT DOCUMENTS 567,895 A 9/1896 Gaiennle
754,215 A 3/1904 Hayward
(Continued)

FOREIGN PATENT DOCUMENTS

CH 568457 A5 10/1975
DK 52370 C 11/1936
(Continued)

OTHER PUBLICATIONS

John P. Broomfield, "Corrosion of Steel in Concrete", 3 pages, 1997.

(Continued)

*Primary Examiner* — Theodore V Adamos
(74) *Attorney, Agent, or Firm* — Stetina Garred Brucker & Newboles

(57) ABSTRACT

A method of laying one or more concrete topping slabs over an existing concrete structure includes providing a concrete form defining an area on a surface of the concrete structure, drilling a hole into the surface of the concrete structure within the area, the hole being closer to a first border of the concrete form than to a second border of the concrete form opposite the first border, attaching first and second slip-dowel receiving sheaths respectively to the first and second borders, securing a first end portion of a bent metal bar in the hole with a second end portion of the bent metal bar extending parallel to the surface and the slip-dowel receiving sheaths toward the second border, and pouring a concrete mixture over the surface of the concrete structure and about the first and second slip-dowel receiving sheaths and the second end portion of the bent metal bar.

13 Claims, 9 Drawing Sheets

(58) Field of Classification Search
CPC ..... E04B 1/483; E04B 1/4114; E04B 1/48; E01C 11/14; E01C 19/504; E01C 23/045
See application file for complete search history.

(56) References Cited

U.S. PATENT DOCUMENTS

| | | | |
|---|---|---|---|
| 1,045,562 | A | 11/1912 | Kennedy |
| 1,545,267 | A | 7/1925 | Marye |
| 1,592,681 | A | 7/1926 | Grothe |
| 1,631,576 | A | 6/1927 | Bowers |
| 1,699,557 | A | 1/1929 | Roy, V |
| 1,728,936 | A | 9/1929 | Johnson |
| 1,755,219 | A | 4/1930 | Knox |
| 1,767,575 | A | 6/1930 | Bujack |
| 1,826,062 | A | 10/1931 | Farmer |
| 1,838,635 | A | 12/1931 | Pilj |
| 1,852,673 | A | 4/1932 | Pilj |
| 1,939,007 | A | 12/1933 | Heltzel |
| 1,942,494 | A | 1/1934 | Robertson |
| 1,953,846 | A | 4/1934 | Briggs |
| 2,039,420 | A | 5/1936 | Isett |
| 2,066,448 | A | 1/1937 | Bahr |
| 2,095,060 | A | 10/1937 | Geyer |
| 2,096,702 | A | 10/1937 | Yeoman |
| 2,108,107 | A | 2/1938 | De Wees |
| 2,110,738 | A | 3/1938 | Parker |
| 2,129,568 | A | 9/1938 | De Biasi |
| 2,166,220 | A | 7/1939 | Older |
| 2,181,005 | A | 11/1939 | Westcott |
| 2,193,129 | A | 3/1940 | Geyer et al. |
| 2,207,168 | A | 7/1940 | Thomas et al. |
| 2,262,704 | A | 11/1941 | Tompkins et al. |
| 2,269,703 | A | 1/1942 | Bagwill |
| 2,275,272 | A | 3/1942 | Scripture, Jr. |
| 2,277,203 | A | 3/1942 | Boult |
| 2,296,453 | A | 9/1942 | Saffert |
| 2,319,526 | A | 5/1943 | Wearn |
| 2,327,231 | A | 8/1943 | Westcott |
| 2,331,949 | A | 10/1943 | Whiteman |
| 2,365,550 | A | 12/1944 | Heltzel |
| 2,373,284 | A | 4/1945 | Autrey |
| 2,508,443 | A | 5/1950 | Carter |
| 2,551,826 | A | 5/1951 | Cox, Sr. |
| 2,636,426 | A | 4/1953 | Heltzel |
| 2,642,789 | A | 6/1953 | Brickman |
| 2,746,365 | A | 5/1956 | Darneille |
| 2,823,539 | A | 2/1958 | Kersh et al. |
| 2,823,573 | A | 2/1958 | Vasikonis et al. |
| 2,858,749 | A | 11/1958 | Crone |
| 2,902,742 | A | 9/1959 | Matich |
| 2,980,215 | A | 4/1961 | Englund |
| 3,066,448 | A | 12/1962 | Pinter |
| 3,124,047 | A | 3/1964 | Graham |
| 3,205,629 | A | 9/1965 | Rumley et al. |
| 3,233,024 | A | 2/1966 | Jackson et al. |
| 3,279,335 | A | 10/1966 | Garner |
| 3,284,973 | A | 11/1966 | Ames et al. |
| 3,318,224 | A | 5/1967 | Bohanon |
| 3,333,380 | A | 8/1967 | Wolf |
| 3,437,017 | A | 4/1969 | Walz et al. |
| 3,451,179 | A | 6/1969 | Kendzia |
| 3,527,486 | A | 9/1970 | Anton |
| 3,603,055 | A | 9/1971 | Dale |
| D229,538 | S | 12/1973 | Steffan |
| 3,896,599 | A | 7/1975 | Werstein et al. |
| 3,920,221 | A | 11/1975 | Berry et al. |
| 3,921,356 | A | 11/1975 | Hughes |
| 4,077,177 | A | 3/1978 | Boothroyd et al. |
| 4,087,072 | A | 5/1978 | Olsen |
| 4,115,976 | A | 9/1978 | Rohrer |
| 4,146,599 | A | 3/1979 | Lanzetta |
| 4,158,937 | A | 6/1979 | Henry |
| D257,503 | S | 11/1980 | Mckee |
| 4,252,767 | A | 2/1981 | Piazza et al. |
| 4,261,496 | A | 4/1981 | Mareydt et al. |
| 4,281,496 | A | 8/1981 | Danielsson |
| 4,329,080 | A | 5/1982 | Elley |
| D272,517 | S | 2/1984 | Koehn |
| 4,437,828 | A | 3/1984 | Egger |
| D273,984 | S | 5/1984 | Vlock |
| 4,449,844 | A | 5/1984 | Larsen |
| 4,493,584 | A | 1/1985 | Guntert |
| 4,496,504 | A | 1/1985 | Steenson et al. |
| 4,533,112 | A | 8/1985 | Santos, Jr. et al. |
| 4,578,916 | A | 4/1986 | Witschi |
| 4,614,070 | A | 9/1986 | Idland |
| 4,619,096 | A | 10/1986 | Lancelot, III |
| 4,648,739 | A | 3/1987 | Thomsen |
| 4,657,430 | A | 4/1987 | Marionneaux |
| 4,726,561 | A | 2/1988 | Worzala |
| 4,748,788 | A | 6/1988 | Shaw et al. |
| 4,752,153 | A | 6/1988 | Miller |
| 4,800,702 | A | 1/1989 | Wheeler |
| 4,801,425 | A | 1/1989 | Michel et al. |
| 4,821,988 | A | 4/1989 | Jimenez |
| 4,883,385 | A | 11/1989 | Kaler |
| 4,899,497 | A | 2/1990 | Madl, Jr. |
| 4,926,593 | A | 5/1990 | Johnston |
| D309,280 | S | 7/1990 | Balfanz-Lee |
| 4,938,631 | A | 7/1990 | Maechtle et al. |
| 4,959,940 | A | 10/1990 | Witschi |
| D314,325 | S | 2/1991 | Ziaylek, Jr. et al. |
| 4,996,816 | A | 3/1991 | Wiebe |
| 5,005,331 | A | 4/1991 | Shaw et al. |
| 5,046,898 | A | 9/1991 | Mckinney |
| 5,096,155 | A | 3/1992 | Fitzgerald |
| 5,097,547 | A | 3/1992 | Tanaka et al. |
| 5,134,828 | A | 8/1992 | Baur |
| 5,205,942 | A | 4/1993 | Fitzgerald |
| 5,212,919 | A | 5/1993 | Shaw et al. |
| 5,216,862 | A | 6/1993 | Shaw et al. |
| 5,301,485 | A | 4/1994 | Shaw et al. |
| 5,363,619 | A | 11/1994 | Mcphee |
| D363,211 | S | 10/1995 | Noble |
| 5,487,249 | A | 1/1996 | Shaw et al. |
| D375,599 | S | 11/1996 | Hirano et al. |
| D375,600 | S | 11/1996 | Hirano et al. |
| 5,618,125 | A | 4/1997 | Mcphee et al. |
| 5,678,952 | A | 10/1997 | Shaw et al. |
| D387,437 | S | 12/1997 | Heaton |
| 5,694,730 | A | 12/1997 | Del Rincon et al. |
| 5,713,174 | A | 2/1998 | Kramer |
| 5,797,231 | A | 8/1998 | Kramer |
| 5,934,821 | A | 8/1999 | Shaw et al. |
| 5,941,045 | A | 8/1999 | Plehanoff et al. |
| D419,700 | S | 1/2000 | Shaw et al. |
| D420,752 | S | 2/2000 | Hiscock |
| 6,018,833 | A | 2/2000 | Imm |
| 6,019,546 | A | 2/2000 | Ruiz |
| 6,039,503 | A | 3/2000 | Cathey |
| 6,092,960 | A | 7/2000 | Mccallion |
| 6,123,485 | A | 9/2000 | Mirmiran et al. |
| 6,145,262 | A | 11/2000 | Schrader et al. |
| 6,171,016 | B1 | 1/2001 | Pauls et al. |
| 6,185,886 | B1 | 2/2001 | Gruen et al. |
| 6,210,070 | B1 | 4/2001 | Shaw et al. |
| 6,243,994 | B1 | 6/2001 | Bernini |
| 6,354,053 | B1 | 3/2002 | Kerrels |
| 6,354,760 | B1 | 3/2002 | Boxall et al. |
| D459,205 | S | 6/2002 | Shaw et al. |
| 6,447,203 | B1 | 9/2002 | Ruiz et al. |
| 6,502,359 | B1 | 1/2003 | Rambo |
| 6,517,277 | B2 | 2/2003 | Hu et al. |
| 6,598,364 | B1 | 7/2003 | Pelles |
| 6,655,869 | B1 | 12/2003 | Deeb et al. |
| 6,775,952 | B2 | 8/2004 | Boxall et al. |
| 6,926,463 | B2 | 8/2005 | Shaw et al. |
| 7,004,443 | B2 | 2/2006 | Bennett |
| 7,314,333 | B2 | 1/2008 | Shaw et al. |
| 7,314,334 | B1 | 1/2008 | Bennett et al. |
| 7,338,230 | B2 | 3/2008 | Shaw et al. |
| 7,381,008 | B2 | 6/2008 | Shaw et al. |
| 7,404,691 | B2 | 7/2008 | Bennett et al. |
| 7,481,031 | B2 | 1/2009 | Boxall et al. |

(56) References Cited

U.S. PATENT DOCUMENTS

| | | | | |
|---|---|---|---|---|
| 7,604,432 | B2 * | 10/2009 | Shaw | E01C 11/14 404/58 |
| 7,637,689 | B2 | 12/2009 | Boxall et al. | |
| 7,716,890 | B2 | 5/2010 | Boxall et al. | |
| 7,736,088 | B2 | 6/2010 | Boxall et al. | |
| D619,885 | S | 7/2010 | Hansort | |
| 7,874,762 | B2 | 1/2011 | Shaw et al. | |
| D634,168 | S | 3/2011 | Ghatikar et al. | |
| 7,967,528 | B2 | 6/2011 | Mercer et al. | |
| 8,007,199 | B2 | 8/2011 | Shaw et al. | |
| 8,142,104 | B2 | 3/2012 | Mercer et al. | |
| 8,302,359 | B2 | 11/2012 | Boxall et al. | |
| 8,303,210 | B2 | 11/2012 | Parkes et al. | |
| 8,356,955 | B2 | 1/2013 | Nadler | |
| 8,381,470 | B2 | 2/2013 | Boxall et al. | |
| 8,511,935 | B1 | 8/2013 | Thomas | |
| 8,573,884 | B2 | 11/2013 | Nadler | |
| D694,725 | S | 12/2013 | Marq | |
| 8,627,626 | B2 | 1/2014 | Boxall et al. | |
| D699,555 | S | 2/2014 | Yazich | |
| 8,677,712 | B1 | 3/2014 | Edmonds, Jr. | |
| 8,713,877 | B2 | 5/2014 | Underwood et al. | |
| 9,255,404 | B2 | 2/2016 | Willems et al. | |
| 9,340,969 | B1 | 5/2016 | Shaw | |
| 9,458,638 | B2 | 10/2016 | Parkes et al. | |
| 9,541,111 | B1 | 1/2017 | Galligan et al. | |
| 9,546,456 | B2 | 1/2017 | Shaw | |
| 9,617,694 | B2 | 4/2017 | Shaw | |
| 9,897,124 | B1 | 2/2018 | Galligan et al. | |
| D850,896 | S | 6/2019 | Shaw | |
| 11,578,491 | B2 * | 2/2023 | Shaw | E04B 5/32 |
| 2002/0066824 | A1 | 6/2002 | Floyd, Jr. et al. | |
| 2003/0144071 | A1 | 7/2003 | Dodge et al. | |
| 2005/0265802 | A1 | 12/2005 | Miller et al. | |
| 2006/0075706 | A1 | 4/2006 | Boxall et al. | |
| 2007/0134063 | A1 | 6/2007 | Shaw et al. | |
| 2008/0014018 | A1 * | 1/2008 | Boxall | E01C 11/14 404/56 |
| 2008/0085155 | A1 | 4/2008 | Bennett et al. | |
| 2008/0307733 | A1 | 12/2008 | Rice et al. | |
| 2009/0060657 | A1 | 3/2009 | Albritton et al. | |
| 2010/0086351 | A1 | 4/2010 | Mercer et al. | |
| 2010/0319295 | A1 | 12/2010 | Nelson | |
| 2011/0085857 | A1 | 4/2011 | Shaw et al. | |
| 2011/0302880 | A1 | 12/2011 | Dipietro | |
| 2014/0248076 | A1 | 9/2014 | Shaw | |
| 2015/0197898 | A1 | 7/2015 | Shaw | |
| 2016/0060817 | A1 | 3/2016 | Collines et al. | |
| 2016/0083914 | A1 | 3/2016 | Shaw | |
| 2016/0222599 | A1 | 8/2016 | Smith | |
| 2016/0377472 | A1 | 12/2016 | Wech | |
| 2017/0096810 | A1 | 4/2017 | Shaw | |
| 2018/0087265 | A1 | 3/2018 | Boyd et al. | |
| 2018/0195280 | A1 | 7/2018 | Pratt | |

FOREIGN PATENT DOCUMENTS

| | | | |
|---|---|---|---|
| DK | 79813 | C | 9/1955 |
| EP | 1123443 | A1 | 8/2001 |
| EP | 1389648 | B1 | 1/2007 |
| FR | 1094449 | A | 5/1955 |
| GB | 1389648 | A | 4/1975 |
| GB | 2507071 | A | 4/2014 |
| JP | 2007297802 | A | 11/2007 |
| JP | 3211680 | U | 7/2017 |
| WO | 0023653 | A1 | 4/2000 |
| WO | 0042265 | A1 | 7/2000 |
| WO | 2014111712 | A1 | 7/2014 |

OTHER PUBLICATIONS www.pavement.com, "Load Transfer", May 27, 2003, 2 pgs.

www.pna-inc.com, "The Diamond Dowel System", May 22, 2003, 2 pgs.

www.danley.com.au, "Danley Diamond Dowel System", Mar. 24, 2005, 2 pgs.

Basham, Kim, Reduce Random Cracking with Plate Dowels, Dec. 31, 2008, obtained from https://www.forconstructionpros.com/concrete/equipment-products/article/10117261/plate-dowels-in-concrete-slabs (Year: 2008).

Patent Cooperation Treaty, International Search Report and Written Opinion for International Application No. PCT/US2018/065803, dated Jan. 28, 2019, 8 pages.

Wayne W. Walker & Jerry A. Holland, "Plate Dowels for Slabs on Ground", Jul. 1998, 4 pgs.

Danley Systems, Slab-on-Ground Industrial, Residential and Pavement Systems Product Catalogue, 2017 (obtained from https://danley.com.au/upload/modules/document_loader/Danley_Catalogue_2017.pdf (Year: 2017).

* cited by examiner

TOPPING SLAB INSTALLATION METHODOLOGY

CROSS-REFERENCE TO RELATED APPLICATIONS

The present application is a continuation of U.S. patent application Ser. No. 16/784,585 filed on Feb. 7, 2020, the entire contents of which are incorporated herein by reference.

STATEMENT RE: FEDERALLY SPONSORED RESEARCH/DEVELOPMENT

Not Applicable

BACKGROUND

1. Technical Field

The present disclosure relates generally to laying concrete and, more particularly, to laying one or more concrete topping slabs over an existing concrete structure.

2. Related Art

In order to reduce costs associated with demolition, an existing concrete structure may be resurfaced with one or more concrete topping slabs. To this end, the existing concrete structure may be partially removed to a specified depth and a concrete mixture may be poured on top to form the concrete topping slabs. Conventionally, the resulting concrete topping slabs may be prevented from curling by bonding the topping slabs to the existing concrete structure. However, this may result in cracking due to the restriction of expansion and contraction caused by the bond. Also, any joints in the existing concrete structure may propagate through to the topping slab.

It is also possible to prevent curling while allowing the topping slabs to move independently from the existing concrete structure, e.g. by floating the topping slabs on a slip sheet. Curling may still be combatted, for example, by replacing conventional slip-dowels between the topping slabs with ninety-degree bars that extend between the topping slabs and into the existing concrete structure below. However, the placement of ninety-degree bars in this way prevents expansion and contraction as each topping slab is effectively anchored at either end by the ninety-degree bar, causing the topping slab to tear itself apart and crack.

BRIEF SUMMARY

The present disclosure contemplates various systems and methods for overcoming the above drawbacks accompanying the related art. One aspect of the embodiments of the present disclosure is a method of laying one or more concrete topping slabs over an existing concrete structure. The method may include providing a concrete form defining an area on a surface of the concrete structure, drilling a hole into the surface of the concrete structure within the area, the hole being closer to a first border of the concrete form than to a second border of the concrete form opposite the first border, attaching a first slip-dowel receiving sheath to the first border of the concrete form, the first slip-dowel receiving sheath extending parallel to the surface of the concrete structure toward the second border of the concrete form along an axis, attaching a second slip-dowel receiving sheath to the second border of the concrete form, the second slip-dowel receiving sheath extending parallel to the axis toward the first border of the concrete form, securing a first end portion of a bent metal bar in the hole with a second end portion of the bent metal bar extending parallel to the axis toward the second border of the concrete form, and pouring a concrete mixture over the surface of the concrete structure and about the first slip-dowel receiving sheath, the second slip-dowel receiving sheath, and the second end portion of the bent metal bar.

The method may include drilling a second hole into the surface of the concrete structure within the area, the second hole being closer to the first border of the concrete form than to the second border of the concrete form, and securing a first end portion of a second bent metal bar in the second hole with a second end portion of the second bent metal bar extending parallel to the axis toward the second border of the concrete form. The pouring of the concrete mixture may include pouring the concrete mixture about the second end portion of the second bent metal bar. The bent metal bar and the second bent metal bar may be on either side of the first slip-dowel receiving sheath in a direction orthogonal to the axis.

The method may include providing a slip sheet on the surface of the concrete structure prior to the pouring of the concrete mixture.

The second end portion of the bent metal bar may be bent ninety degrees relative to the first end portion of the bent metal bar.

Another aspect of the embodiments of the present disclosure is a method of laying one or more concrete topping slabs over an existing concrete structure. The method may include providing a concrete form defining an area on a surface of the concrete structure adjacent to an already-cured concrete topping slab, drilling a hole into the surface of the concrete structure within the area, the hole being closer to a border of the concrete form opposite the already-cured concrete topping slab than to the already-cured concrete topping slab, attaching a slip-dowel receiving sheath to the border of the concrete form, the slip-dowel receiving sheath extending parallel to the surface of the concrete structure toward the already-cured concrete topping slab along an axis, securing a first end portion of a bent metal bar in the hole with a second end portion of the bent metal bar extending parallel to the axis toward the already-cured concrete topping slab, and pouring a concrete mixture over the surface of the concrete structure and about the slip-dowel receiving sheath, the second end portion of the bent metal bar, and a slip-dowel protruding from the already-cured concrete topping slab.

The method may include drilling a second hole into the surface of the concrete structure within the area, the second hole being closer to the border of the concrete form than to the already-cured concrete topping slab, and securing a first end portion of a second bent metal bar in the second hole with a second end portion of the second bent metal bar extending parallel to the axis toward the already-cured concrete topping slab. The pouring of the concrete mixture may include pouring the concrete mixture about the second end portion of the second bent metal bar. The bent metal bar and the second bent metal bar may be on either side of the slip-dowel receiving sheath in a direction orthogonal to the axis.

The method may include providing a slip sheet on the surface of the concrete structure prior to the pouring of the concrete mixture.

The second end portion of the bent metal bar may be bent ninety degrees relative to the first end portion of the bent metal bar.

Another aspect of the embodiments of the present disclosure is a method of laying one or more concrete topping slabs over an existing concrete structure. The method may include providing a concrete form defining an area on a surface of the concrete structure adjacent to an already-cured concrete topping slab, drilling a hole into the surface of the concrete structure within the area, the hole being closer to the already-cured concrete topping slab than to a border of the concrete form opposite the already-cured concrete topping slab, attaching a slip-dowel receiving sheath to the border of the concrete form, the slip-dowel receiving sheath extending parallel to the surface of the concrete structure toward the already-cured concrete topping slab along an axis, securing a first end portion of a bent metal bar in the hole with a second end portion of the bent metal bar extending parallel to the axis toward the border of the concrete form, and pouring a concrete mixture over the surface of the concrete structure and about the slip-dowel receiving sheath, the second end portion of the bent metal bar, and a slip-dowel protruding from the already-cured concrete topping slab parallel to the axis.

The method may include drilling a second hole into the surface of the concrete structure within the area, the second hole being closer to the already-cured concrete topping slab than to the border of the concrete form, and securing a first end portion of a second bent metal bar in the second hole with a second end portion of the second bent metal bar extending parallel to the axis toward the border of the concrete form. The pouring of the concrete mixture may include pouring the concrete mixture about the second end portion of the second bent metal bar. The bent metal bar and the second bent metal bar may be on either side of the slip-dowel in a direction orthogonal to the axis.

The method may include providing a slip sheet on the surface of the concrete structure prior to the pouring of the concrete mixture.

The second end portion of the bent metal bar may be bent ninety degrees relative to the first end portion of the bent metal bar.

Another aspect of the embodiments of the present disclosure is a method of laying one or more concrete topping slabs over an existing concrete structure. The method may include drilling a hole into a surface of the concrete structure within an area on the surface of the concrete structure defined at least in part by a plurality of adjacent already-cured concrete topping slabs, the hole being closer to a first one of the already-cured concrete topping slabs than to a second one of the already-cured concrete topping slabs opposite the first, securing a first end portion of a bent metal bar in the hole with a second end portion of the bent metal bar extending parallel to the surface of the concrete structure toward the second one of the already-cured concrete topping slabs along an axis, and pouring a concrete mixture over the surface of the concrete structure and about a first slip-dowel protruding from the first one of the already-cured concrete topping slabs parallel to the axis, a second slip-dowel protruding from the second one of the already-cured concrete topping slabs parallel to the axis, and the second end portion of the bent metal bar.

The method may include drilling a second hole into the surface of the concrete structure within the area, the second hole being closer to the first one of the already-cured concrete topping slabs than to the second one of the already-cured concrete topping slabs, and securing a first end portion of a second bent metal bar in the second hole with a second end portion of the second bent metal bar extending parallel to the axis toward the second one of the already-cured concrete topping slabs. The pouring of the concrete mixture may include pouring the concrete mixture about the second end portion of the second bent metal bar. The bent metal bar and the second bent metal bar may be on either side of the first slip-dowel in a direction orthogonal to the axis.

The method may include providing a slip sheet on the surface of the concrete structure prior to the pouring of the concrete mixture.

The second end portion of the bent metal bar may be bent ninety degrees relative to the first end portion of the bent metal bar.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

The present disclosure encompasses various embodiments of systems and methods for laying one or more concrete topping slabs over an existing concrete structure. The detailed description set forth below in connection with the appended drawings is intended as a description of several currently contemplated embodiments, and is not intended to represent the only form in which the disclosed invention may be developed or utilized. The description sets forth the functions and features in connection with the illustrated embodiments. It is to be understood, however, that the same or equivalent functions may be accomplished by different embodiments that are also intended to be encompassed within the scope of the present disclosure. It is further understood that the use of relational terms such as first and second and the like are used solely to distinguish one from another entity without necessarily requiring or implying any actual such relationship or order between such entities.

Figure 1:
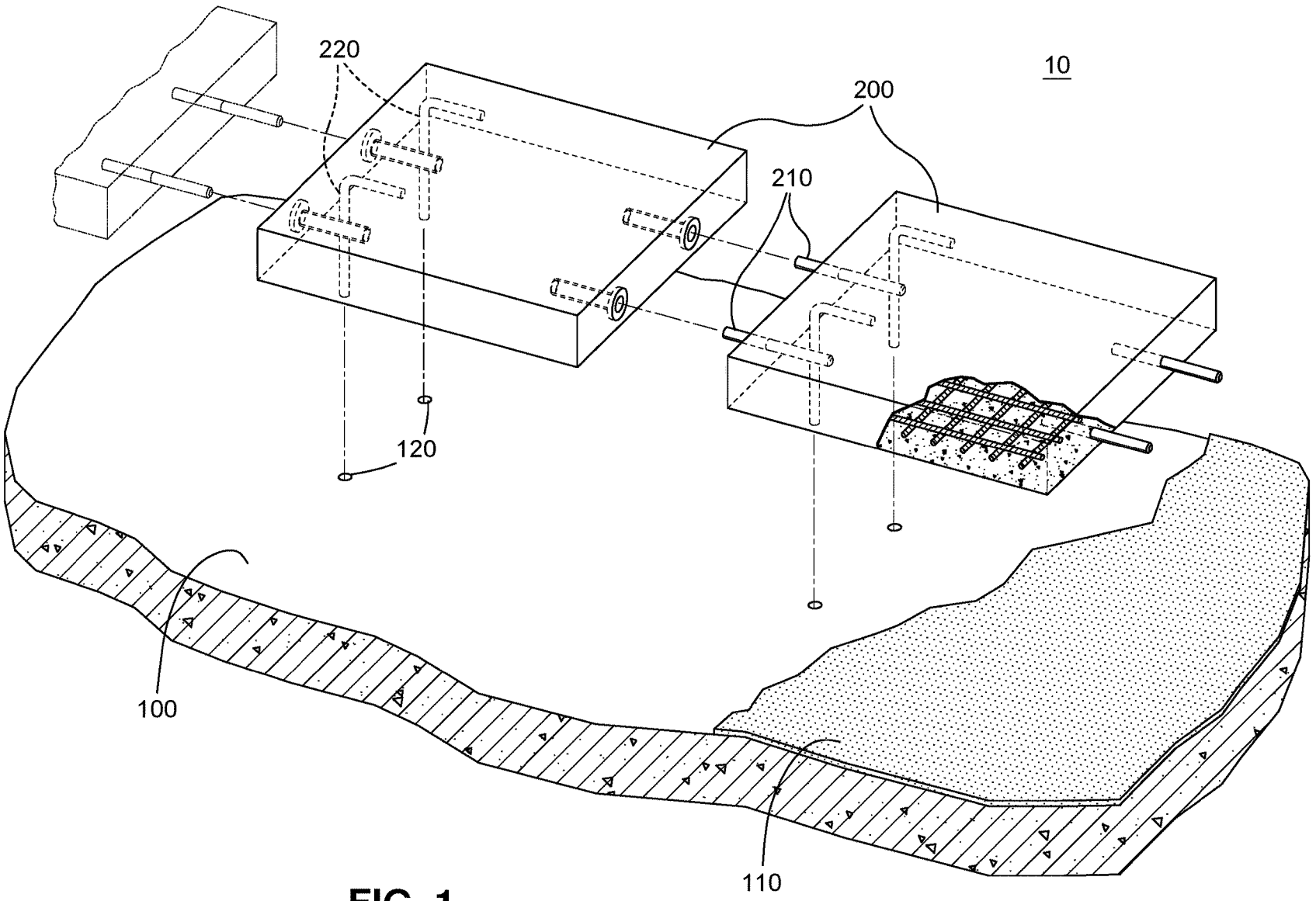
FIG. 1 is an exploded perspective view of a concrete topping slab system according to an embodiment of the present disclosure.

FIG. 1 is an exploded perspective view of a concrete topping slab system 10 according to an embodiment of the present disclosure. One or more concrete topping slabs 200 may be formed over an existing concrete structure 100 with a slip sheet 110 therebetween. Each of the concrete topping slab(s) 200 may be secured to adjacent concrete topping slab(s) 200 by slip-dowels 210 to prevent undesirable bucking or unevenness of the cold joint between the adjacent slabs 200 while also permitting linear expansion and contraction of the slabs 200 in the direction of the slip-dowels 210. In order to prevent curling, one or more bent metal bars 220 may secure each of the slab(s) 200 to the existing concrete structure 100 at one end of the slab 200 while extending parallel to the slip-dowels 210 toward an opposite end of the slab 200. Because each of the slab(s) 200 need only be anchored to the existing concrete structure 100 at one end, the slab(s) 200 are allowed to thermally expand and contract in the direction of the slip-dowels 210 without being prevented from doing so by the bent metal bar(s) 220.

Figure 2:
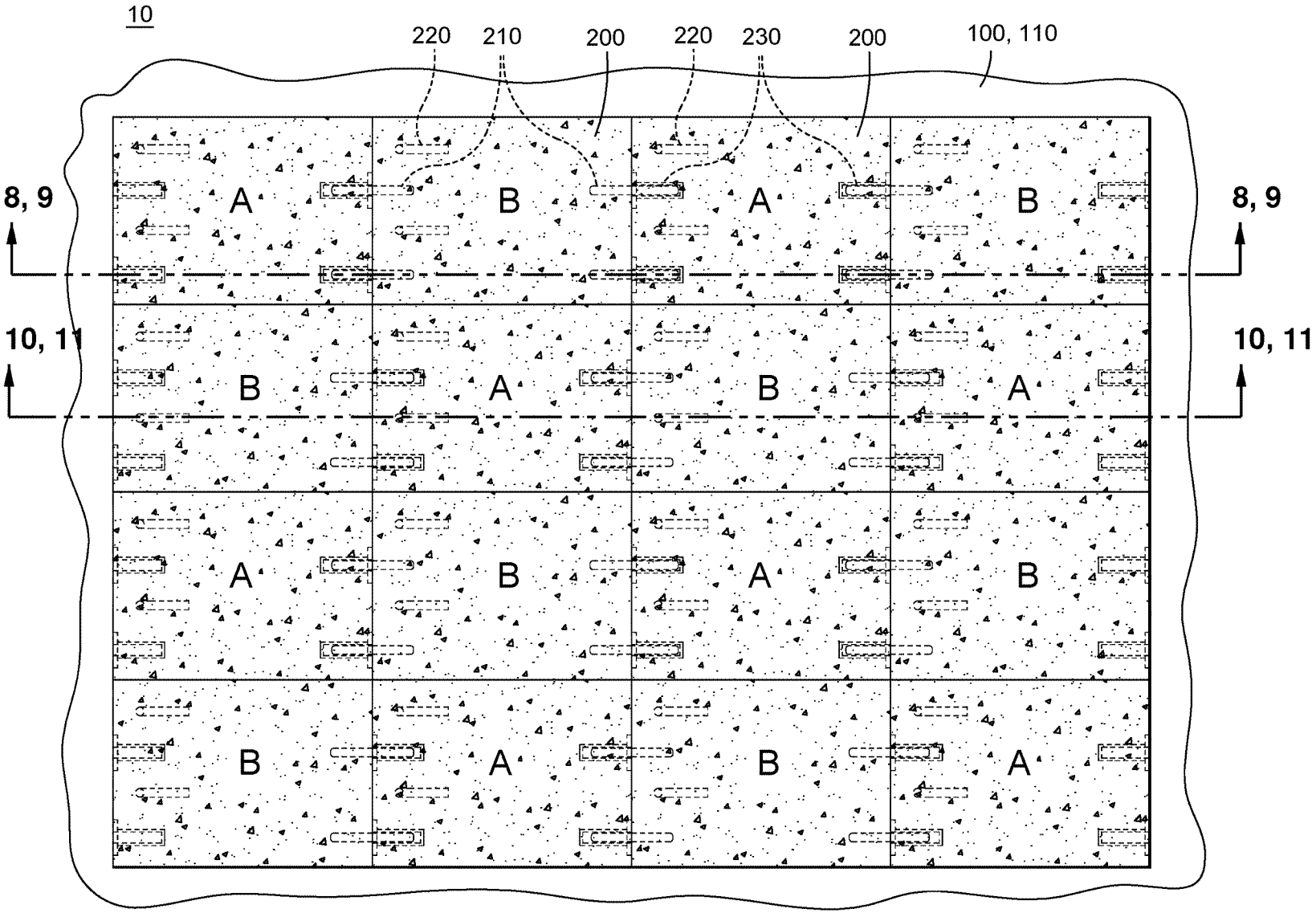
FIG. 2 is a plan view of the concrete topping slab system.

FIG. 2 is a plan view of the concrete topping slab system 10. As shown, the concrete topping slab system 10 may comprise a grid of concrete topping slabs 200 secured to each other by slip-dowels 210 in a single direction (horizontal in FIG. 2). In this way, the slip-dowels 210 may be allowed to slide within corresponding slip-dowel receiving sheaths 230 as the slabs 200 expand and contract. By arranging the bent metal bars 220 to extend parallel to the slip-dowels 210, the interference of the bent metal bars 220 with this expansion and contraction may be minimized.

The grid of concrete topping slabs 200 shown in FIG. 2 may be efficiently produced by forming the slabs 200 in a checkerboard pattern as shown, with the concrete mixture for the slabs 200 marked "A" poured in a first pouring step and the concrete mixture for the slabs 200 marked "B" poured in a subsequent second pouring step. An example process for producing the concrete topping slab system 10 according to such a checkerboard pattern is shown and described in relation to FIGS. 3-7. However, it should be noted that non-checkerboard patterns for producing a grid of concrete topping slabs 200, as well as non-grid arrangements of concrete topping slabs 200, are also contemplated as being encompassed by the concrete topping slab system 10.

Figure 3:
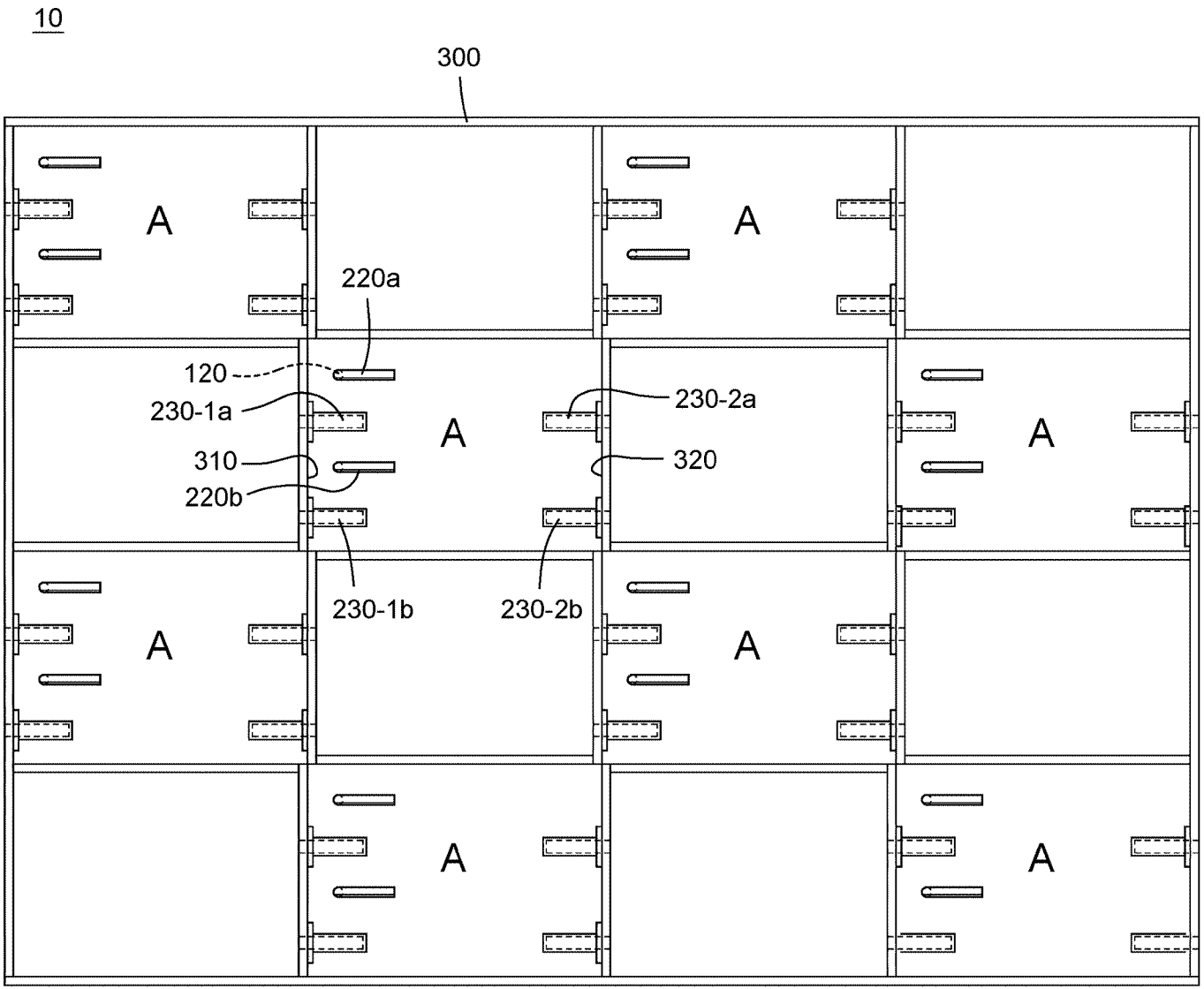
FIG. 3 is a plan view of the concrete topping slab system showing a preparation step for forming a first set of concrete topping slabs.

FIG. 3 is a plan view of the concrete topping slab system 10 showing a preparation step for forming a first set of concrete topping slabs 200 (marked "A") according to a checkerboard pattern. With the existing concrete structure 100 having been partially removed to the desired depth and a slip sheet 110 (see FIGS. 1 and 2) having been provided on the newly revealed surface thereof, the process illustrated in FIGS. 3-7 may begin with a step of providing a concrete form 300. The concrete form 300 may be made of wood (e.g. two-by-fours) and may define one or more areas on the surface of the concrete structure 100 where the topping slab(s) 200 will be formed. Using any of the areas marked "A" as an example, the process may continue with drilling a hole 120 (see FIG. 1 for perspective view) into the surface of the concrete structure 100 within the area. If a slip sheet 110 is provided, the hole may be drilled through the slip sheet 110 as well. The hole 120 may be drilled at one end of the area that will define the slab 200. That is, the hole 120 may be closer to a first border 310 of the concrete form 300 than to a second border 320 of the concrete form 300 opposite the first border 310.

The process may continue with attaching slip-dowel receiving sheaths 230 to the first and second borders 310, 320 of the concrete form 300. Namely, a first slip-dowel receiving sheath 230-1*a* may be attached to the first border 310 and a second slip-dowel receiving sheath 230-2*a* may be attached to the second border 320 (though in some cases one of the slip-dowel receiving sheaths 230 may be omitted if there will be no further adjacent concrete). The first slip-dowel receiving sheath 230-1*a* may be attached so as to extend parallel to the surface of the concrete structure 100 toward the second border 320. The direction that the first slip-dowel receiving sheath 230-1*a* extends may define an axis along which expansion and contraction of the topping slab 200 will be permitted in the finished concrete topping slab system 10. The second slip-dowel receiving sheath 230-2*a* may extend parallel to this axis toward the first border 310 of the concrete form 300. As shown, the second slip-dowel receiving sheath 230-2*a* may extend along the same axis as the first slip-dowel receiving sheath 230-1*a* so as to be aligned with one another, but unaligned slip-dowel receiving sheaths 230-1*a*, 230-2*a* are contemplated as well. Note, for example, that opposite borders 310, 320 of a form 300 defining a non-rectangular area (e.g. a parallelogram) may not face each other, such that aligned slip-dowel receiving sheaths 230-1*a*, 230-2*a* may be infeasible or undesirable. Along the same lines, it should be noted that the opposite borders 310, 320 need not necessarily be parallel (e.g. in the case of a triangular area), as long as the slip-dowel receiving sheaths 230-1*a*, 230-2*a* may be attached to the borders 310, 320 in a way that allows them to extend parallel to each other and allow expansion/contraction of the slab 200 along an axis.

Figure 10:
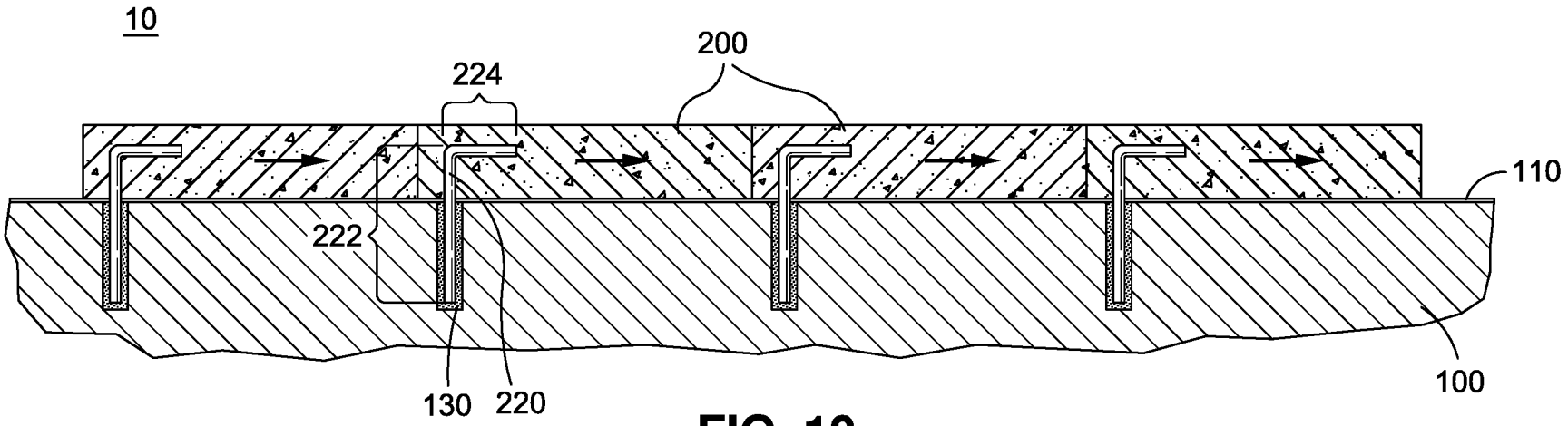
FIG. 10 is a cross-sectional view of the concrete topping slab system taken along line 10,11-10,11 in FIG. 2 showing an expanded state of the concrete topping slabs.

With the hole 120 having been drilled into the existing concrete structure 100 and through any intervening slip sheet 110, the process may continue with securing a bent metal bar 220 (e.g. the bent metal bar 220*a* shown in FIG. 3) in the hole 120. Referring briefly to FIG. 10, which is a cross-sectional view of the concrete topping slab system 10 taken along line 10,11-10,11 in FIG. 2, it can be seen that each bent metal bar 220 may have a first end portion 222 that is secured in the hole 120 (e.g. by an epoxy 130) and a second end portion 224 that extends parallel to the surface of the concrete topping slab system 10. The bent metal bars 220 may be made of steel and may be rebar for example. Referring back to the plan view of FIG. 3, in which only the second end portion 224 can be seen, it can be seen that the bent metal bar 220*a* may be secured in the hole 120 such that the second end portion 224 extends parallel to the same axis as the slip-dowel receiving sheaths 230-1*a*, 230-2*a* toward the second border 320 of the concrete form 300. Owing to this arrangement, the bent metal bar 220*a* may serve as an anchor to prevent curling of the topping slab 200 without unduly restricting thermal expansion and contraction along the axis.

It is contemplated that a plurality of bent metal bars 220 may be provided in a plurality of holes 120 drilled closer to the first border 310 than the second border 320 of the concrete form 300, with each of the bent metal bars 220 having a second end portion 224 extending parallel to the same axis as the slip-dowel receiving sheaths 230-1*a*, 230-2*a* toward the second border 320 of the concrete form 300. In this regard, the illustrated example depicts the bent metal bar 220*a* (the first bent metal bar 220*a*) and a second bent metal bar 220*b* on either side of the first slip-dowel receiving sheath 230-1*a* in a direction orthogonal to the expansion/contraction axis. Along the same lines, a plurality of slip dowels 210 may be used between each pair of adjacent slabs 300. As shown, for example, two first slip-dowel receiving sheaths 230-1*a*, 230-1*b* are attached to the first border 310 alternating with the plurality of bent metal bars 220*a*, 220*b*. Likewise, two second slip-dowel receiving sheaths 230-2*a*, 230-2*b* are shown attached to the second border 320 of the concrete form 300. Using greater numbers of alternating bent metal bars 220 and slip dowels 210 is also contemplated.

Figure 4:
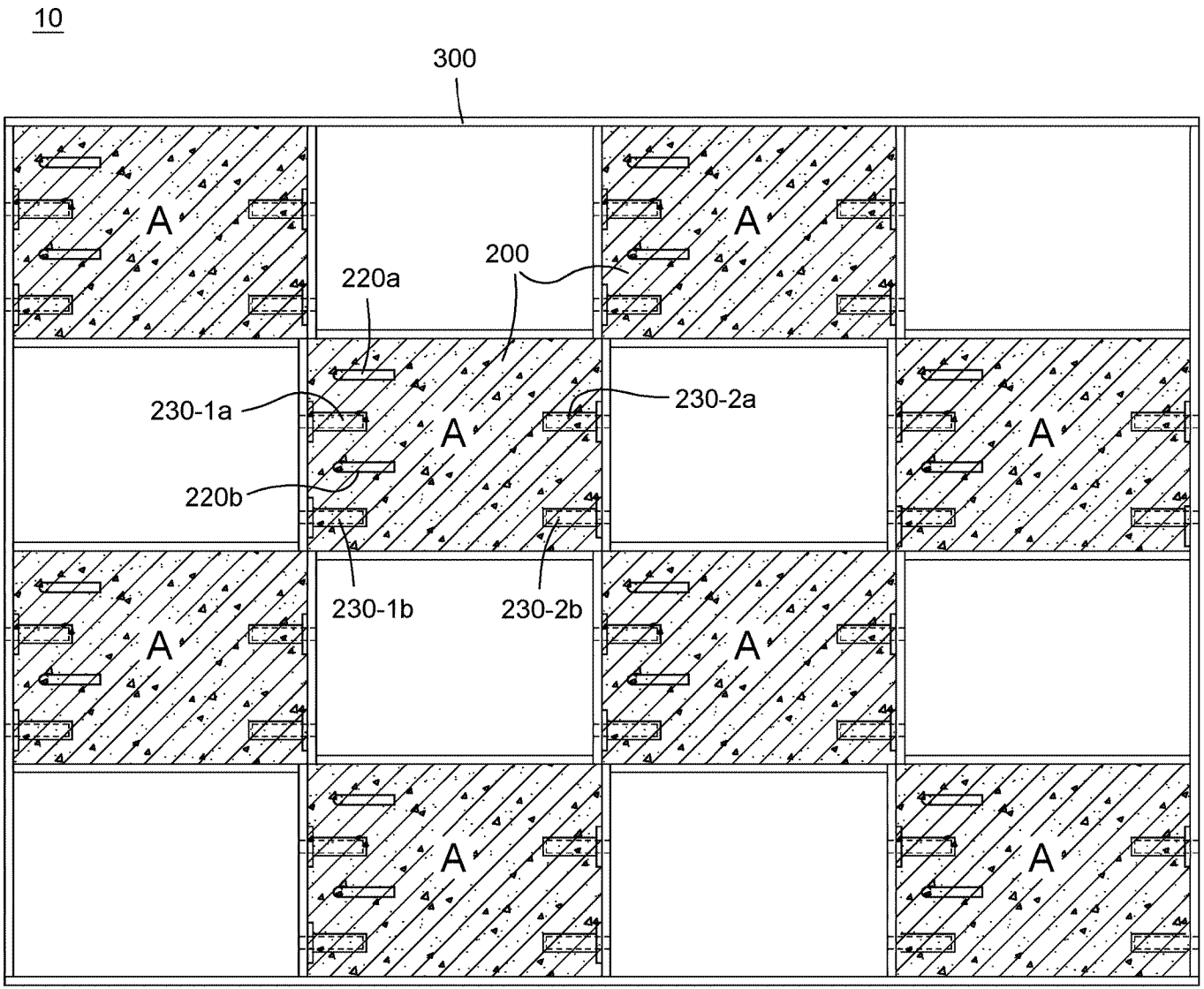
FIG. 4 is a plan view of the concrete topping slab system showing a concrete pouring step for forming the first set of concrete topping slabs.

FIG. 4 is a plan view of the concrete topping slab system 10 showing a concrete pouring step for forming the first set of concrete topping slabs 200. With the areas for forming the first set of concrete topping slabs 200 (marked "A") having been prepared as described in relation to FIG. 3, the method may continue with pouring a concrete mixture over the surface of the concrete structure 100 and about the first slip-dowel receiving sheath 230-1*a*, the second slip-dowel receiving sheath 230-2*a*, and the second end portion 224 (see FIG. 10) of the bent metal bar 220*a*. If additional bent metal bars 220 and slip dowels 210 are used as shown in FIG. 4, the concrete mixture may additionally be poured about the second end portion 224 of a second bent metal bar 220*b*, etc., as well as about additional slip-dowel receiving sheaths 230 as described above. As shown in FIG. 4, the concrete mixture may fill the area defined by the concrete form 300, namely each of the areas marked "A", and thereafter cure to form concrete topping slabs 200 in a checkerboard pattern.

Figure 5:
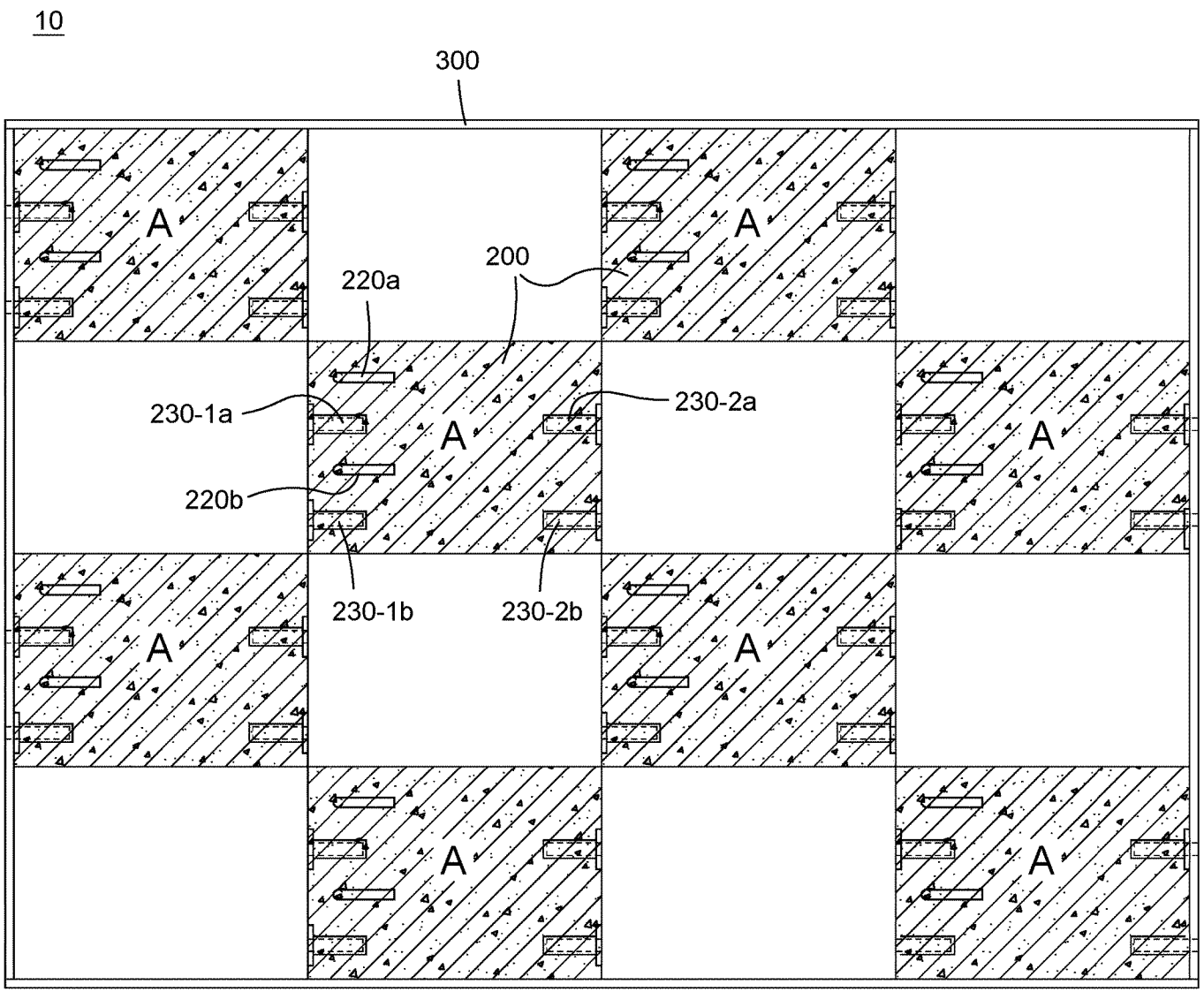
FIG. 5 is a plan view of the concrete topping slab system showing a removal of a concrete form.

FIG. 5 is a plan view of the concrete topping slab system 10 showing a removal of the concrete form 300. Once the concrete topping slabs 200 corresponding to the areas marked "A" have cured, the concrete form 300 may be removed in those places where the slabs 200 will be used for the subsequent pour. In the example shown, only the outer perimeter of the concrete form 300 is left in place, with all of the borders between slabs 200 removed. The already-cured concrete topping slabs 200 may now be used in place of the form 300 to define the area for a subsequent pour.

Figure 6:
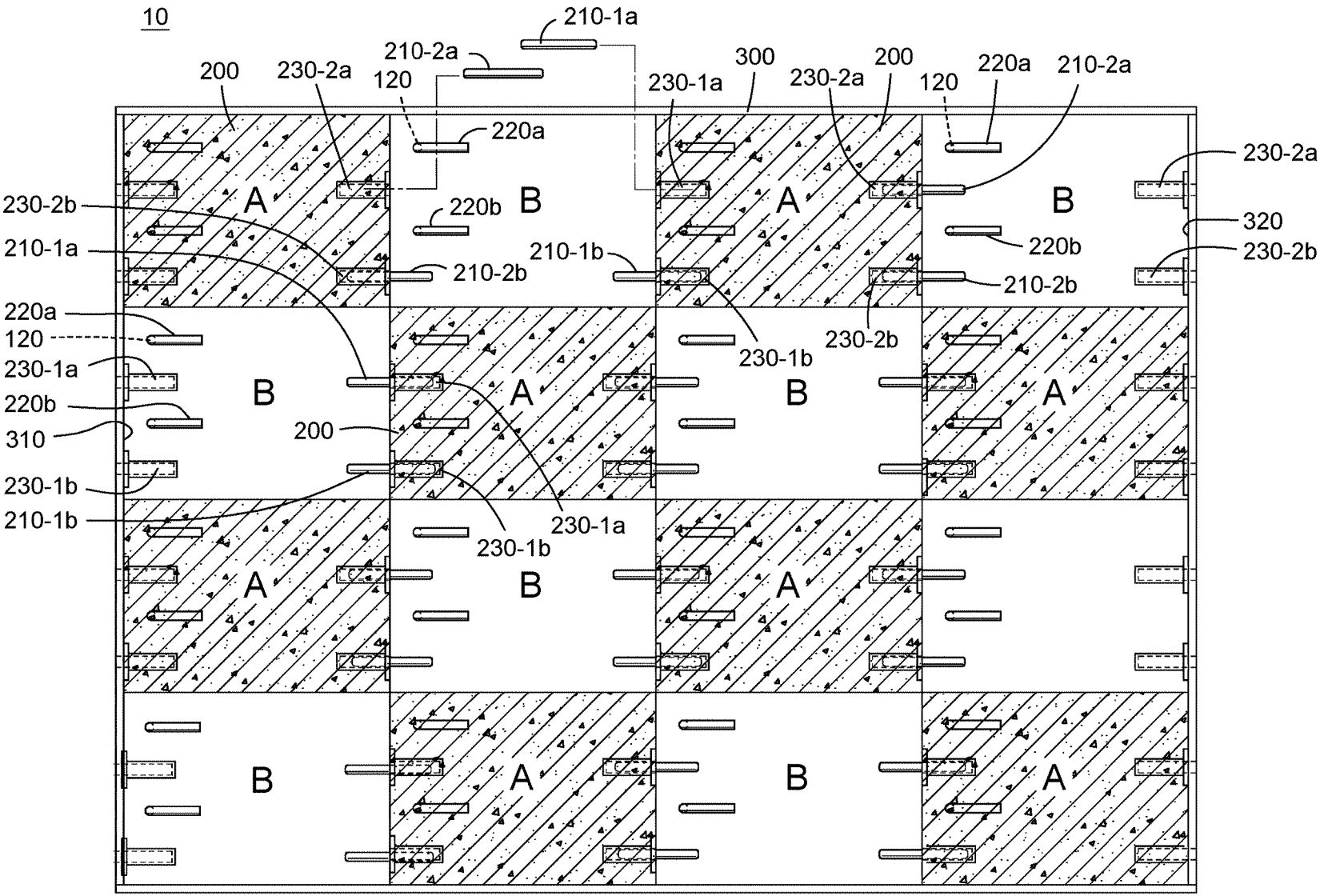
FIG. 6 is a plan view of the concrete topping slab system showing a preparation step for forming a second set of concrete topping slabs.

FIG. 6 is a plan view of the concrete topping slab system 10 showing a preparation step for forming a second set of concrete topping slabs 200 (marked "B"). The preparation for forming the second set of slabs 200 (marked "B") may be the same as the preparation for forming the first set of slabs (marked "A") except that a slip-dowel 210 may be provided instead of a slip-dowel receiving sheath 230 wherever the area is bordered by an already-cured slab 200. Thus, referring by way of example to either of the two areas marked "B" along the left-hand side of the concrete form 300 shown in FIG. 6, the holes 120, bent metal bars 220*a*, 220*b*, and slip-dowel receiving sheaths 230-1*a*, 230-1*b* may be provided as described above in relation to the areas marked "A" (though in some cases the slip-dowel receiving sheaths 230-1*a*, 230-1*b* may be omitted here if there will be no further adjacent concrete). However, in place of a second border 320 opposite the first border 310 of the form 300, there is an already-cured concrete topping slab 200. Therefore, instead of attaching slip-dowel receiving sheaths 230-2*a*, 230-2*b* as described in relation to the "A" areas, slip-dowels 210-1*a*, 210-1*b* are inserted into the already-existing slip-dowel receiving sheaths 230-1*a*, 230-1*b* of the already-cured slab 200.

Referring, as another example, to either of the two areas marked "B" along the right-hand side of the concrete form 300 shown in FIG. 6, the holes 120, bent metal bars 220*a*, 220*b*, and slip-dowel receiving sheaths 230-2*a*, 230-2*b* may again be provided as described above in relation to the areas marked "A" (though in some cases the slip-dowel receiving sheaths 230-2*a*, 230-2*b* may be omitted here if there will be no further adjacent concrete). However, in place of a first border 310 opposite the second border 320 of the form 300, there is an already-cured concrete topping slab 200. Therefore, instead of attaching slip-dowel receiving sheaths 230-1*a*, 230-1*b* as described in relation to the "A" areas, slip-dowels 210-2*a*, 210-2*b* are inserted into the already-existing slip-dowel receiving sheaths 230-2*a*, 230-2*b* of the already-cured slab 200.

In the case of the four areas marked "B" down the middle of the concrete form 300 shown in FIG. 6 (i.e. neither on the left-hand side nor on the right-hand side of the concrete form 300), the holes 120 and bent metal bars 220*a*, 220*b* may be provided as described above in relation to the areas marked "A". However, in place of the first and second borders 310, 320 of the form 300, there are already-cured concrete topping slabs 200. Therefore, instead of attaching slip-dowel receiving sheaths 230-1*a*, 230-1*b*, 230-2*a*, 230-2*b* as described in relation to the "A" areas, slip-dowels 210-1*a*, 210-1*b*, 210-2*a*, 210-2*b* are respectively inserted into the already-existing slip-dowel receiving sheaths 230-1*a*, 230-1*b*, 230-2*a*, 230-2*b* of the already-cured slabs 200.

Figure 7:
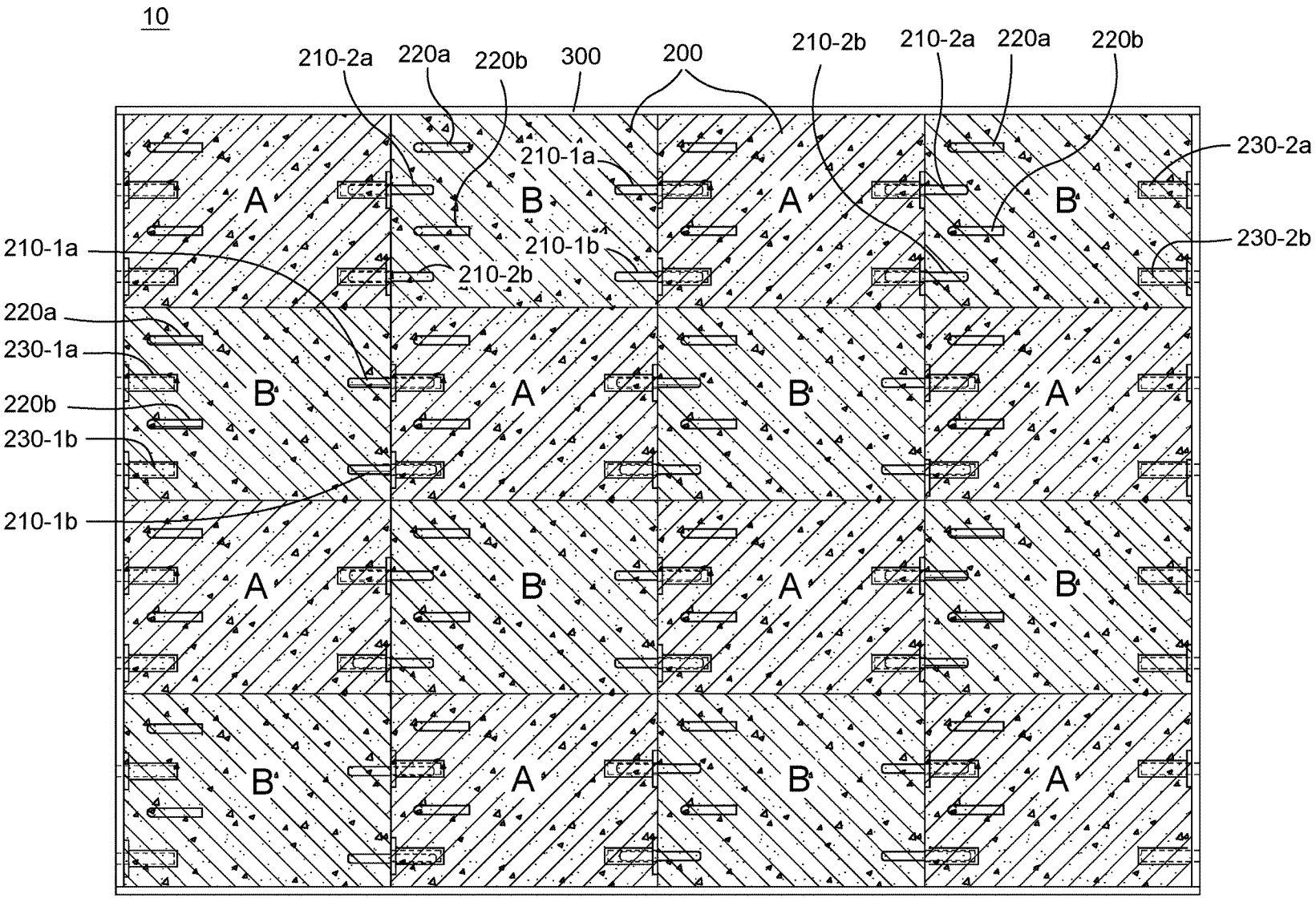
FIG. 7 is a plan view of the concrete topping slab system showing a concrete pouring step for forming the second set of concrete topping slabs.

FIG. 7 is a plan view of the concrete topping slab system 10 showing a concrete pouring step for forming the second set of concrete topping slabs 200. With the areas for forming the second set of concrete topping slabs 200 (marked "B") having been prepared as described in relation to FIG. 6, the method may continue with pouring a concrete mixture over the surface of the concrete structure 100 and about the slip-dowel receiving sheath(s) 230, slip-dowel(s) 210, and second end portion(s) 224 (see FIG. 10) of the bent metal bar(s) 220 as may variously be provided in each of the "B" areas as described in relation to FIG. 6. As shown in FIG. 7, the concrete mixture may fill the area defined by the concrete form 300, namely each of the areas marked "B", and thereafter cure to complete the checkerboard pattern of concrete topping slabs 200. The remaining portion of the concrete form 300 may then be removed to produce the concrete topping slab system 10 shown in FIG. 2.

For ease of explanation, an example process is described above in relation to FIGS. 3-7. However, except where specifically indicated or logically required, the order of the steps is not critical. For example, the holes 120 may be drilled for both the "A" and "B" areas all at the same time, either before or after the concrete form 300 is built, the slip-dowel receiving sheaths 230 may be attached to the form 300 before or after the bent metal bars 220 are secured to the existing concrete structure 100 (and before or after the holes 120 are drilled), etc. Along the same lines, additional steps may occur before, after, or between the steps described. For example, reinforcing steel in the form of mesh, rods, and/or bars (e.g. rebar) may be disposed in the areas "A" and "B" prior to pouring the concrete mixture to produce a reinforced concrete topping slab 200 (see FIG. 1 cutaway). As another example, a moisture barrier made of felt or polyethylene plastic sheeting (e.g. Visqueen) may be provided, either between adjacent slabs 200 (e.g. applied prior to pouring the concrete mixture of the "B" areas) or at arbitrarily determined periodic locations (e.g. applied by saw-cutting the finished project). Along the same lines, expansion joints made of felt, wood (e.g. redwood), plastic, or other suitable material may be provided between adjacent slabs 200, having a thickness depending on the size of the slabs 200 (e.g. half-inch expansion joints).

Figure 8:
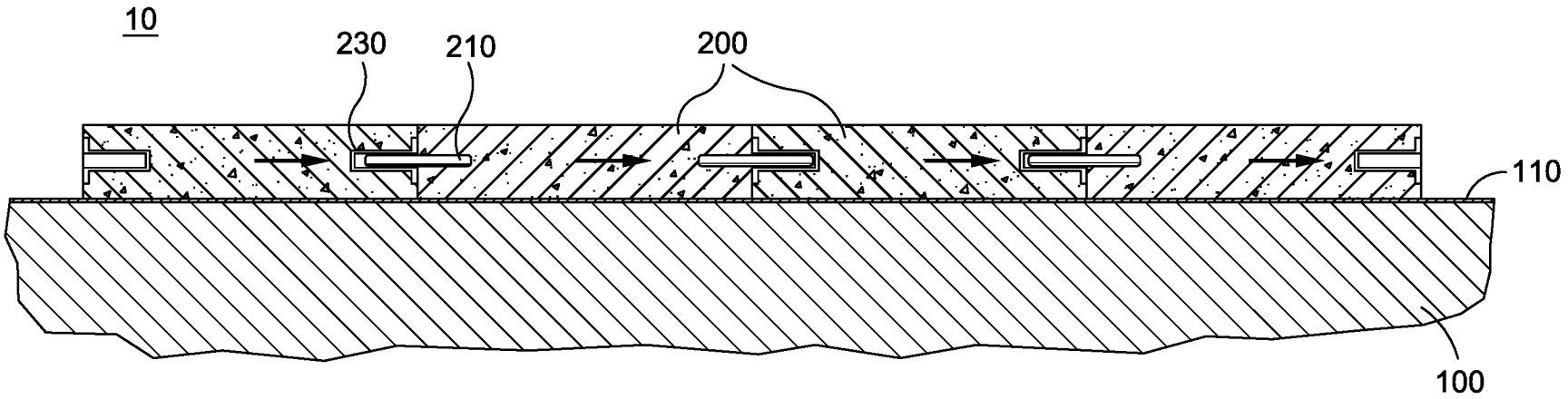
FIG. 8 is a cross-sectional view of the concrete topping slab system taken along line 8,9-8,9 in FIG. 2 showing an expanded state of the concrete topping slabs.
Figure 9:
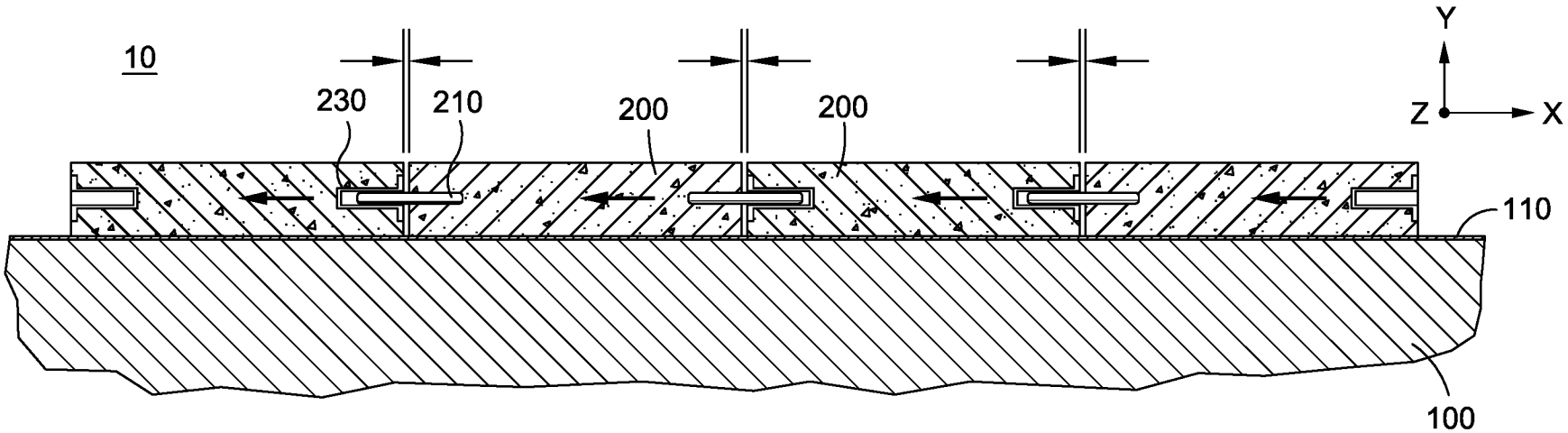
FIG. 9 is another cross-sectional view of the concrete topping slab system taken along line 8,9-8,9 in FIG. 2 showing a contracted state of the concrete topping slabs.

FIG. 8 is a cross-sectional view of the concrete topping slab system 10 taken along line 8,9-8,9 in FIG. 2 showing an expanded state of the slabs 200. FIG. 9 is the same view showing a contracted state of the slabs 200. As illustrated in FIGS. 8 and 9, the slip-dowels 210 may allow thermal expansion and contraction parallel to the X-direction as the slip-dowels 210 are free to slide in the slip-dowel receiving sheaths 230. At the same time, the slip-dowels 210 may prevent undesirable bucking or unevenness of the cold joint between the adjacent slabs 200.

Figure 11:
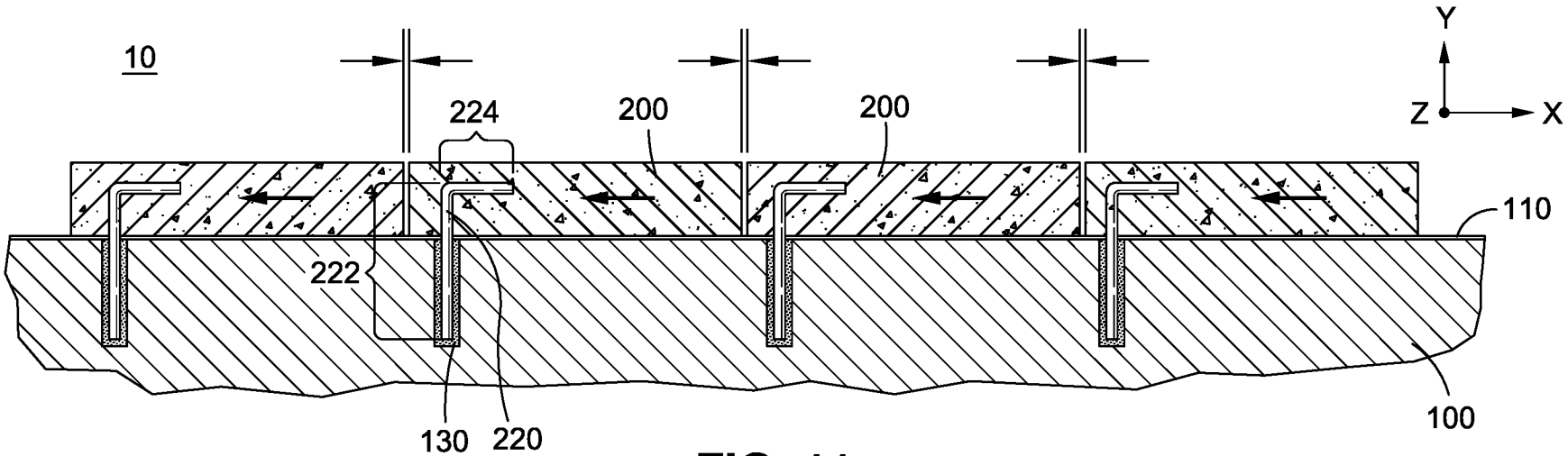
FIG. 11 is another cross-sectional view of the concrete topping slab system taken along line 10,11-10,11 in FIG. 2 showing a contracted state of the concrete topping slabs.

FIG. 10 is a cross-sectional view of the concrete topping slab system 10 taken along line 10,11-10,11 in FIG. 2 showing an expanded state of the slabs 200. FIG. 11 is the same view showing a contracted state of the slabs 200. As shown and discussed above, each of the bent metal bars 220 may include a first end portion 222 that is secured (e.g. by epoxy 130) in a hole 120 drilled in the existing concrete structure 100 and a second end portion 224 that extends parallel to the surface of the existing concrete structure 100. The second end portion 224 may be bent ninety degrees relative to the first end portion 222 as shown. However, other angles are possible as well, with the hole 120 being drilled at a corresponding angle such that the bend results in the second end portion 224 being parallel to the surface. As illustrated in FIGS. 10 and 11, the bent metal bars 220 provided only at one end of each slab 200 may anchor the slabs 200 to the existing concrete structure 100 while still allowing thermal expansion and contraction parallel to the X-direction. In particular, in FIG. 10 (and FIG. 8), the rightward facing arrows show the direction of expansion as the free end of each slab 200 that is not anchored by a bent metal bar 220 is allowed to expand. Likewise, in FIG. 11 (and FIG. 9), the leftward facing arrows show the direction of contraction as the free end of each slab 200 that is not anchored by a bent metal bar 220 is allowed to contract.

The slip-dowels 210 and slip-dowel receiving sheaths 230 described herein, as well as the method of attaching the slip-dowel receiving sheaths 230 to the concrete form 300, may be according to known slip-dowel systems and methods such as those described in any of U.S. Pat. No. 5,678,952, entitled "CONCRETE DOWEL PLACEMENT APPARATUS," U.S. Pat. No. 5,934,821, entitled "CONCRETE DOWEL PLACEMENT APPARATUS," and U.S. Pat. No. 9,617,694, entitled "CONCRETE DOWEL SYSTEM," the entire disclosures of all of which are expressly incorporated herein by reference.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A method of laying one or more concrete topping slabs over an existing concrete structure, the method comprising:

providing a concrete form defining an area on a surface of the concrete structure;

drilling a plurality of holes into the surface of the concrete structure within the area;

attaching a slip-dowel receiving sheath to the concrete form, the slip-dowel receiving sheath extending parallel to the surface of the concrete structure along an axis;

inserting a plurality of bent metal bars into respective ones of the plurality of holes such that a first end portion of each bent metal bar is received in the respective one of the plurality of holes and a second end portion of each bent metal bar extends in a common direction parallel to the axis; and pouring a concrete mixture over the surface of the concrete structure and about the slip-dowel receiving sheath and the second end portions of the plurality of bent metal bars.

2. The method of claim 1, wherein the plurality of bent metal bars includes a pair of bent metal bars on either side of the slip-dowel receiving sheath in a direction orthogonal to the axis.

3. The method of claim 1, further comprising providing a slip sheet on the surface of the concrete structure prior to said pouring the concrete mixture.

4. The method of claim 1, wherein the second end portion of each bent metal bar is bent ninety degrees relative to the first end portion of the corresponding bent metal bar.

5. The method of claim 1, wherein the area defined by the concrete form is adjacent to at least one already-cured concrete topping slab.

6. A method of laying one or more concrete topping slabs over an existing concrete structure, the method comprising:

providing a concrete form defining an area on a surface of the concrete structure adjacent to an already-cured concrete topping slab having a slip-dowel receiving sheath, the slip-dowel receiving sheath extending parallel to the surface of the concrete structure along an axis;

drilling at least two holes into the surface of the concrete structure within the area;

securing a first end portion of at least two bent metal bars in respective ones of the at least two holes with a second end portion of each bent metal bar extending in a common direction parallel to the axis;

inserting a slip-dowel into the slip-dowel receiving sheath of the already-cured concrete topping slab so as to protrude therefrom; and pouring a concrete mixture over the surface of the concrete structure and about the second end portions of the at least two bent metal bars and the slip-dowel protruding from the already-cured concrete topping slab.

7. The method of claim 6, wherein the at least two bent metal bars include a pair of bent metal bars on either side of the slip-dowel in a direction orthogonal to the axis.

8. The method of claim 6, further comprising providing a slip sheet on the surface of the concrete structure prior to said pouring the concrete mixture.

9. The method of claim 6, wherein the second end portion of each bent metal bar is bent ninety degrees relative to the first end portion of the corresponding bent metal bar.

10. A method of laying one or more concrete topping slabs over an existing concrete structure, the method comprising:

drilling a plurality of holes into a surface of the concrete structure within an area on the surface of the concrete structure defined at least in part by one or more adjacent already-cured concrete topping slabs, at least one of the one or more adjacent already already-cured concrete topping slabs having a slip-dowel receiving sheath, the slip-dowel receiving sheath extending parallel to the surface of the concrete structure along an axis;

securing a first end portion of at least two bent metal bars in respective ones of the at least two holes with a second end portion of each bent metal bar extending in a common direction parallel to the axis;

inserting a slip-dowel into the slip-dowel receiving sheath so as to protrude therefrom; and pouring a concrete mixture over the surface of the concrete structure to form the one or more concrete topping slabs, the concrete mixture being poured about the second end portions of the at least two bent metal bars and the slip-dowel protruding from the at least one of the one or more adjacent already-cured concrete topping slabs.

11. The method of claim 10, wherein a pair of the at least two bent metal bars are on either side of the slip-dowel in a direction orthogonal to the axis.

12. The method of claim 10, further comprising providing a slip sheet on the surface of the concrete structure prior to said pouring the concrete mixture.

13. The method of claim 10, wherein the second end portion of each bent metal bar is bent ninety degrees relative to the first end portion of the corresponding bent metal bar.

* * * * *